United States Patent [19]

Terry

[11] 4,093,310

[45] June 6, 1978

[54] SEALING AN UNDERGROUND COAL DEPOSIT FOR IN SITU PRODUCTION

[75] Inventor: Ruel C. Terry, Denver, Colo.

[73] Assignee: In Situ Technology, Inc., Denver, Colo.

[21] Appl. No.: 834,182

[22] Filed: Sep. 19, 1977

Related U.S. Application Data

[62] Division of Ser. No. 774,597, Mar. 7, 1977.

[51] Int. Cl.[2] ..... E21B 33/13

[52] U.S. Cl. ..... 299/2; 166/292

[58] Field of Search ..... 166/285, 259, 261, 272, 166/292; 299/2, 11, 12; 175/39, 42

[56] References Cited

U.S. PATENT DOCUMENTS

| | | | |
|---|---|---|---|
| 1,660,187 | 2/1928 | Ehrat | 299/2 |
| 1,661,389 | 3/1928 | Sinclair | 299/2 |
| 1,867,758 | 7/1932 | Ranney | 299/2 |
| 3,856,186 | 2/1975 | Von Hippel | 299/2 X |
| 3,924,680 | 12/1975 | Terry | 166/258 |
| 4,015,663 | 4/1977 | Strubhar | 166/259 X |

*Primary Examiner*—Stephen J. Novosad

[57] ABSTRACT

A previously mined underground coal deposit is sealed so that the underground void space can be pressurized for production by in situ techniques. Excavated communication passages are sealed by barricades which are further sealed by applying hydrostatic head pressure. Subsidence cracks are sealed by injection of mud slurry with additional sealing effected by maintaining hydrostatic head pressure with a column of the slurry. In situ production wells are drilled into the coal with hermetic seal accomplished in part by cementing a portion of the liner to the well bore and in part by the hydrostatic head pressure of a mud slurry positioned above the cement seal. Coal is ignited and burn patterns are established to cause reasonably uniform subsidence.

6 Claims, 3 Drawing Figures

SEALING AN UNDERGROUND COAL DEPOSIT FOR IN SITU PRODUCTION

This is a division of application Ser. No. 774,597, filed Mar. 7, 1977.

BACKGROUND OF THE INVENTION

It is well known in the art how to extract coal from deeply buried coal deposits. One method widely practiced is the so called "room and pillar" technique wherein the coal is extracted from the rooms and is left in place in the pillars. Size of each remnant coal pillar is dictated in part by the weight of the overburden which in itself may vary widely over the coal deposit in mountainous terrain. Lengths and widths of the various rooms are dictated in part by the hazards of roof fall, while the height of the room is generally controlled by the thickness of the coal seam. In some cases the thickness of the coal seam is greater than the efficient capacity of existing mining equipment and a portion of the coal seam is left unmined in the roof and in the floor. In such cases it is not uncommon to find examples where less than 50% of the coal in place has been removed when mining is completed and the mine abandoned.

The creation of void spaces underground induces significant stresses in the overburden and concentrates vertical loads in the remnant pillars. Coal, being a nonhomogenous rock, inherently introduces uncertainties as to its vertical load carrying capabilities in any given location. Further, vertical load distribution is uneven among massive barrier pillars on the periphery of the mine (or around mine shafts) and each remnant pillar. It is not uncommon to find cases where the vertical load imposed on a particular remnant pillar exceeds the compressive strength of the coal, resulting in bursting of the pillar and shifting additional vertical loads to adjacent remnant pillars which also may burst. The result is a downwarping of the overburden, which in severe cases can cause tension cracks opening up from the mine workings through the overburden on to the surface of the ground above the mine.

While the tensional cracks tend to be in a near vertical alignment on the periphery of the downwarped overburden, compressive forces are predominent near the upper center of the downwarped area and normally cause buckling of the earth's crust. Any man-made structures in the path of these shifts in the earth's surface will be substantially damaged. Such shifting is commonly called subsidence.

Subsidence effects at the surface of the ground may be noticeable during the course of mining. In other cases the subsidence effects may not be apparent for many years after the mine is abandoned. Subsidence cracks can be several feet wide at the surface and pose grave hazards if left unattended. Hazards to people and animals are obvious. If the abandoned mine happens to be above the normal water table, a potential fire hazard also exists if one crack serves as an air intake and another crack serves as a chimney. Filling the cracks with inert material may correct the hazardous situation although there is no assurance that another crack will not appear without warning. The potential threat of additional subsidence can be eliminated by filling the void space underground, a practice that generally is more costly than the value of the coal originally removed. Or the mine may be reopened, if it is safe to do so, and the remnant pillars removed by further mining. Generally, abanoned mines fall far short of meeting modern day safety requirements and the cost of upgrading the old mine may be disproportionate to expected revenues from the coal recovered from the remnant pillars.

In many cases the lingering perils of subsidence over the years can be substantially foreshortened and effectively controlled by consuming the remnant pillars in situ, using methods disclosed in the instant invention together with methods taught in U.S. Pat. Nos. 3,987,852; 3,952,802 and 3,948,320; U.S. Pat. application Ser. Nos. 619,562 filed Oct. 6, 1975, now U.S. Pat. No. 4,010,801, and 665,128 filed Mar. 8, 1976, now U.S. Pat. No. 4,018,481; all of the instant inventor.

By consuming the remnant pillars in situ the roof of the mine can be lowered in a reasonably uniform manner until the roof and the floor substantially coincide, thereby ending the threat of further subsidence. The necessity of subjecting personnel to the hazards of old underground workings also is eliminated. Further, much of the coal remaining in place, including that in the roof and in the floor, can be converted to useful products such as low BTU fuel gas, synthesis gas, mixed coal chemicals and the like.

To accomplish the planned results the old mine workings must be sealed and remain sealed so that the underground chambers can be converted into pressurized reaction zones. Then the in situ techniques of gasification, liquefaction and pyrolysis can be employed to convert remaining coal into commercial products.

OBJECTS OF THE INVENTION

It is an objective of the instant invention to teach methods of applying pressure tight seals to an underground coal deposit.

It is an objective of the instant invention to teach methods of control of in situ reactions so that underground coal can be consumed in accordance with a predetermined plan.

Other objectives, capabilities and advantages of the instant invention will become apparent as the description proceeds and in conjunction with the drawings.

SUMMARY OF INVENTION

Figure 1:
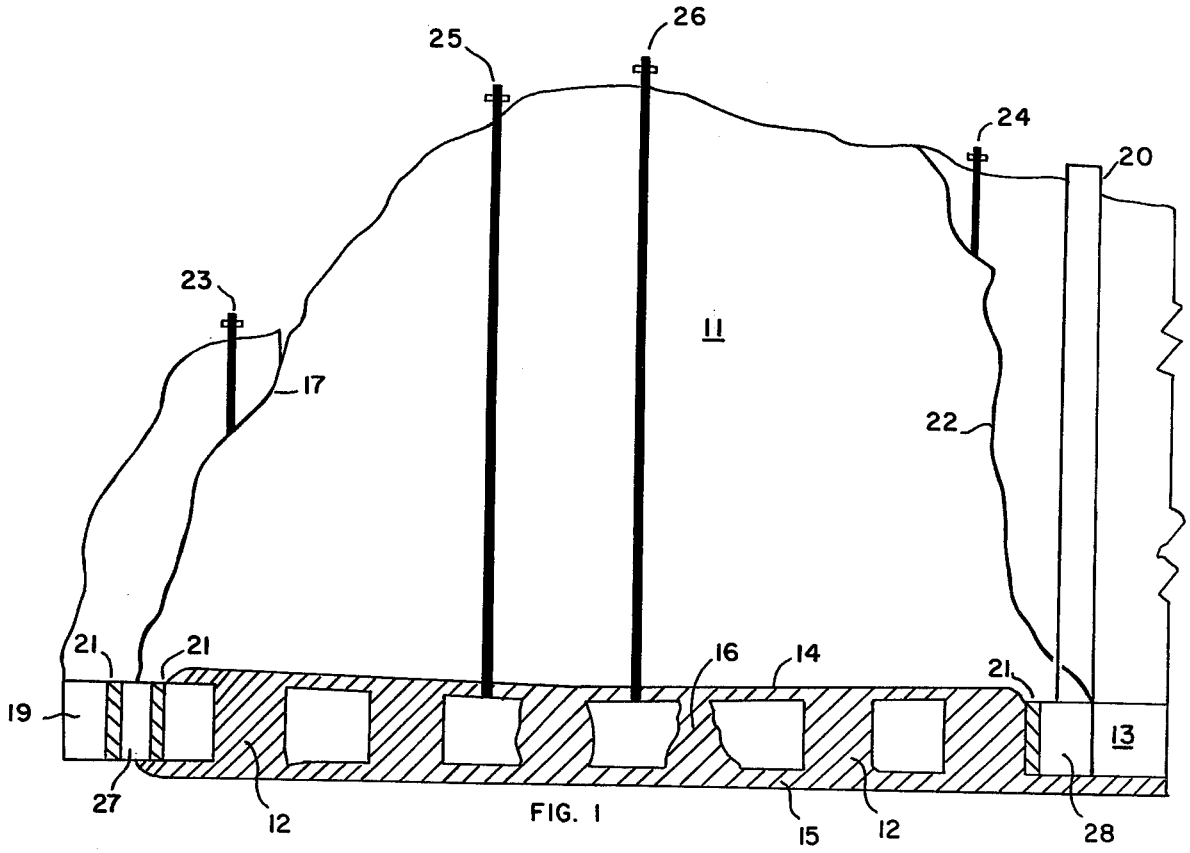
FIG. 1 is a diagrammatic vertical section taken through a portion of the earth, showing the arrangement of apparatus used in the methods of the instant invention.

Referring to FIG. 1, an underground coal deposit is overlain by overburden 11. The coal deposit has been previously mined to economic depletion by room and pillar techniques. Coal remains in place in the remnant pillars 12, barrier pillar 13, in the roof 14 and in the floor 15. Remnant pillar 16 has failed in compression causing downwarping of the overburden 11 with resultant subsidence cracks 17 & 22. The original mining operations had entry 19 and ventilation shaft 20, and barricades 21 were erected at the close of operations to seal the mine. Due to subsidence the seal has been altered by cracks 17 and 22, and the damage to shaft 20 when crack 22 intersected the shaft. Mud slurry injection well 23 has been drilled into crack 17 and mud slurry injection well 24 has been drilled into crack 22. Injector-production wells 25 and 26 are two of a series of wells that are drilling into the coal deposit with bottoms of the holes located preferably in the top of the void space or rooms within the coal. A slush mud slurry is prepared in surface facilities (not shown) and the slurry is injected into wells 23 and 24 and into shaft 20. Slurry injection is continued until a static head is established of sufficient height to contain the expected mine pressure when in situ production is undertaken, for example 50 psig. The slurry serves not only as a gas tight sealant but also to lubricate cracks 17 and 22 so that overburden 11 may be lowered reasonably uniformly as the remnant pillars are consumed. Should additional subsidence cracks develop during the period of planned subsidence, these cracks also should be mudded off similar to cracks 17 and 22.

A multiplicity of injector-production wells 25 and 26 is drilled into the coal formation and the coal is set afire using techniques common in the production of coal in situ. The fire is sustained by injection of oxidizer, preferably compressed air. Products of combustion are withdrawn through appropriate injector-producer wells, with proper back pressure maintained on the withdrawal wells to maintain desired mine pressure, for example 50 psig. Initially there will be considerable void space volume within the coal underground and the fire of necessity will be located in a relatively small portion of the mine. As the burning proceeds the temperature of the gases undergound will gradually increase to the point where the temperature is above the ignition temperature of the exposed coal. It is during this phase that propagation of the fire is easiest to attain in the coal making up the roof of the underground workings. In time all of the exposed coal will be heated to a temperature above its ignition temperature and fire propagation becomes a function of oxidizer distribution underground.

As the burning proceeds the process of subsidence accelerates. It is necessary to maintain sufficient mud slurry capacity to deliver mud to subsidence cracks at sufficient volumes to maintain the mud slurry seal and thus contain the mine pressure. With continuing subsidence the void space underground is significantly diminished and the efficiency of the in situ production processes is significantly increased. Near the end of the production program when substantially all of the coal available for reaction has been consumed, the project is terminated by injecting copious quantities of water into the residual void space until the remnants of coal and the surrounding rock is below the ignition temperature of the coal.

Thus it may be seen that abandoned coal mines may be further produced to resource exhaustion using in situ production techniques thereby utilizing wasted resources and terminating the threat of subsidence damages.

DESCRIPTION OF THE PREFERRED EMBODIMENT

For illustration purposes the methods taught herein are directed to the special case of an abandoned underground coal mine that was produced by room and pillar techniques. Those skilled in the art will recognize that these methods also may be applied to underground coal deposits partially recovered by other techniques and in some cases to virgin coal deposits.

The coal deposit as illustrated in FIG. 1 has been mined by driving an entry 19 into the side of a hill that is underlain by a coal deposit. The economically recoverable coal has been extracted by room and pillar techniques with ventilation provided by shaft 20. Barrier pillar of coal 13 has been left in place at the property limit line. Upon completion of mining barricades 21 were installed to seal the mine. In time after abandonment, remnant pillar 16 failed in compression causing partial failure of nearby remnant pillars. Downwarping of the overburden 11 induced tension cracks 17 and 22. Open cracks 17 and 22 sometimes called subsidence cracks, presented hazards to wild animals and hikers and provided conduits from the surface of the ground into the old workings. For safety purposes the area of cracks in the surface may be contained within a barrier fence to prevent accidental falls.

The process begins by drilling mud injection wells 23 and 24 to their intersection with crack 17 and 24 respectively, with the well bores suitably cased to prevent slumping of the well bore. A suitable sealant fluid is prepared in surface facilities (not shown), such fluid in its simplest form being a mud slurry composed of water and approximately 40% solids such as native clay. Other "muds" commonly used in the drilling of petroleum wells may also be used together with various mud additives commonly used in the petroleum industry. It is important that the sealant fluid be non flammable and perferably non toxic. It is further preferable that the sealant fluid be composed in part of solid materials that remain within the fluid at high velocities and tend to settle out of the fluid at low velocities. For example, upon injection of the sealant fluid into well 23, the fluid should remain as a slurry as it rapidly descends into crack 17 and into the void space 27 between the barricades 21 immediately below crack 17. Then as the fluid velocity is diminished the solids in the slurry should settle out and fill the void space 27 with solids. Any leaks around barricades will also result in low fluid velocities with the solids settling out to plug the leaks.

Sealant fluid injection is continued through well 23 until a proper fluid head pressure is established in crack 17, for example a fluid head pressure is established in crack 17, for example a fluid head pressure that will provide a seal against a mine pressure of 50 psig. Once the fluid head pressure is stabilized at the desired level it is important that the fluid head pressure be maintained at that level. It is preferable to install a liquid level sensor (not shown) in crack 17 so that further injection of fluid is automatically initiated when the liquid level descends below the desired level.

Crack 22 is similarly treated with sealant fluid after sealant fluid injection well 24, sometimes called mud injection well, is drilled and completed. The void space 28 is filled with solids settling out of the slurry and the injection of the slurry is continued until the proper fluid head pressure is attained in crack 22 and shaft 20. Should the sealant action in crack 22 be such that an insufficient fluid head is attained in shaft 20, injection of the mud slurry should be undertaken into shaft 20 until the desired fluid head pressure is attained also in shaft 20.

In this mode the underground workings are now sealed so that the mine may be pressurized to the desired level, for example 50 psig. In some cases the fluid seal may not be completely effective, resulting in the slurry carrier liquid continuously leaking at slow rates into the mine workings. In these cases a fluid removal well (not shown) can be drilled into the underground workings, preferably located at the lowest point in the underground workings, and the migrant carrier liquid can be pumped to the surface for recycling. Later in the production cycle the pumping of the carrier liquid may be terminated and the carrier liquid utilized in situ as a part of the production process. The well, previously used for withdrawing accumulated liquids then may be converted and used as an injector-producer well for the in situ processes.

Figure 3:
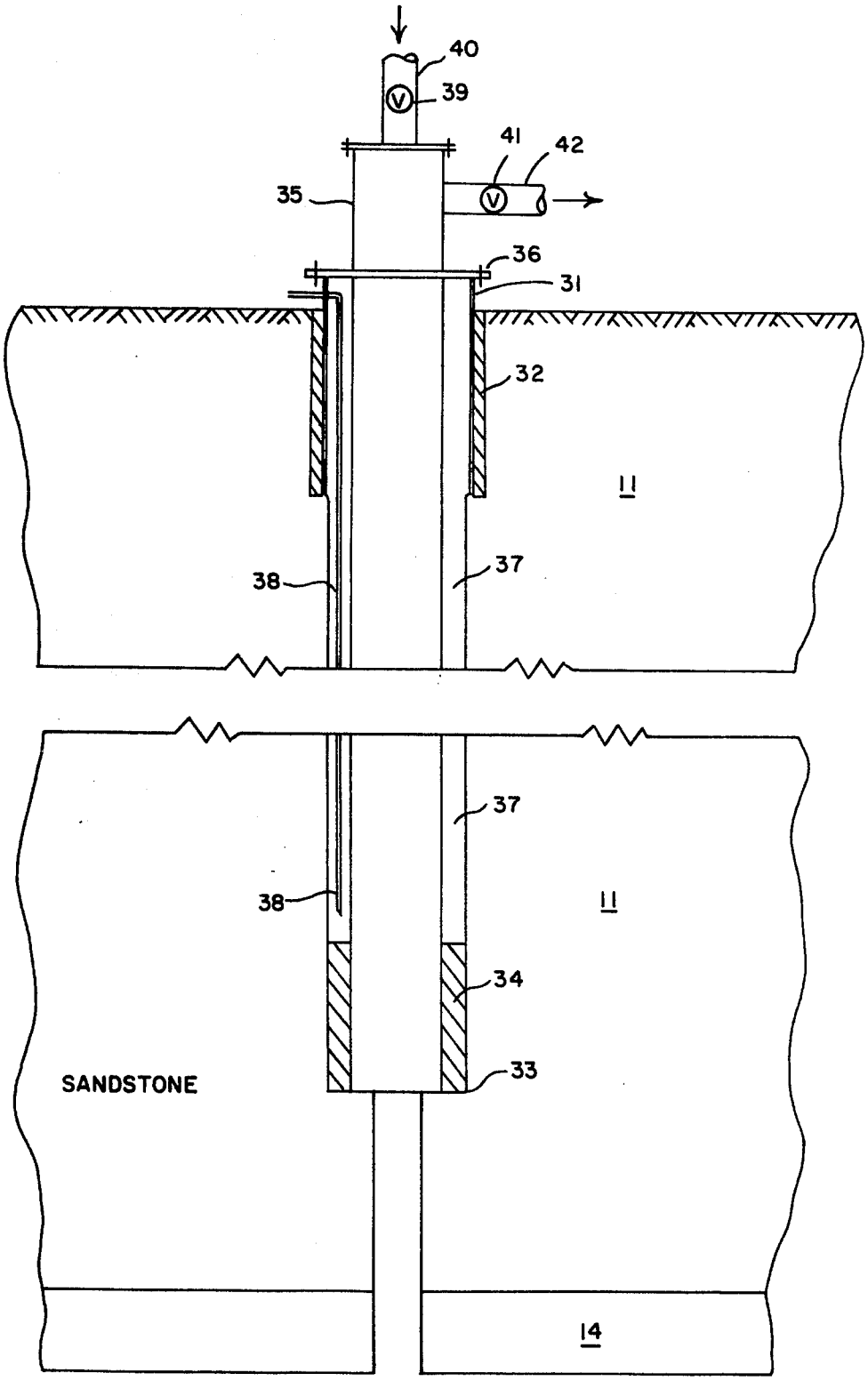
FIG. 3 is a diagrammatic vertical section of a production well.

Referring to FIG. 3, with the underground workings sealed to withstand the desired mine pressure, for example 50 psig, injector-production wells 26 are drilled from the surface of the earth through the overburden 11 and through the roof of the underground workings 14. Each well is lined with a surface casing 31 with the bottom of the casing located at a convenient depth, for example 50 feet below the surface of the ground. The casing is cemented in place. The bore hole is then deepened to a point 33 in the overburden near the top of the coal. Point 33 is located in a competent rock strata in the overburden, preferably sandstone. A liner 35, for example 9 inches in diameter, is installed from the surface of the ground through retaining bracket 36, with the bottom of the liner landed at point 33. The bottom of liner 35 is cemented 34 in place for a vertical distance for example of 10 feet. Retaining bracket 36 serves the purpose of positioning liner 35 within casing 31 so that liner 35 may elongate without restraint. The well bore is then deepened from point 33 through coal 14.

It is important that the lower cement seal 34 be positioned with due regard for competent rock strata in the lower part of the overburden in order to provide a proper seal. Preferably the remainder of the annulus 37 between the bore hole and the liner 35 above the lower cement seal 34 is filled with mud slurry to complete the hermetic seal of the injector-producer well. Such an arrangement provides a cushion around liner 35 so that damage to the liner is minimized when further earth shifts occur as a result of continuing subsidence. Also this arrangement permits the liner 35 to elongate and contract with varying temperatures expected to be encountered in the production cycle.

In some cases the mud slurry or sealant material used in the well bore should be composed of a liquid carrier fluid other than water, preferably a liquid with a boiling point temperature higher than that of water. In other cases, particularly those in which the casing is subjected to gas temperatures in excess of 1000° F, it may be desirable to install a slurry injection tubing 38 in the well bore annulus 37 from the surface of the ground to a point near the lower cement seal 34 so that the slurry may be circulated within annulus 37 to provide cooling for liner 35.

At the top of liner 35 suitable wellhead fixtures are installed to permit injection and withdrawal of fluids in the production cycle. Such fixtures are sealed to complete the hermetic seal between the underground workings and surface facilities. As shown in FIG. 3 tubing 40 contains valve 39 and tubing 42 contains valve 41. Tubing 40 could be connected to a compressor delivering oxidizer to well 26 when well 26 is programmed to be an injector well, and in this mode valve 41 would remain closed. Tubing 42 could be connected to gas clean-up facilities when well 26 is programmed to be a producer well, and in this mode valve 39 would remain closed.

Figure 2:
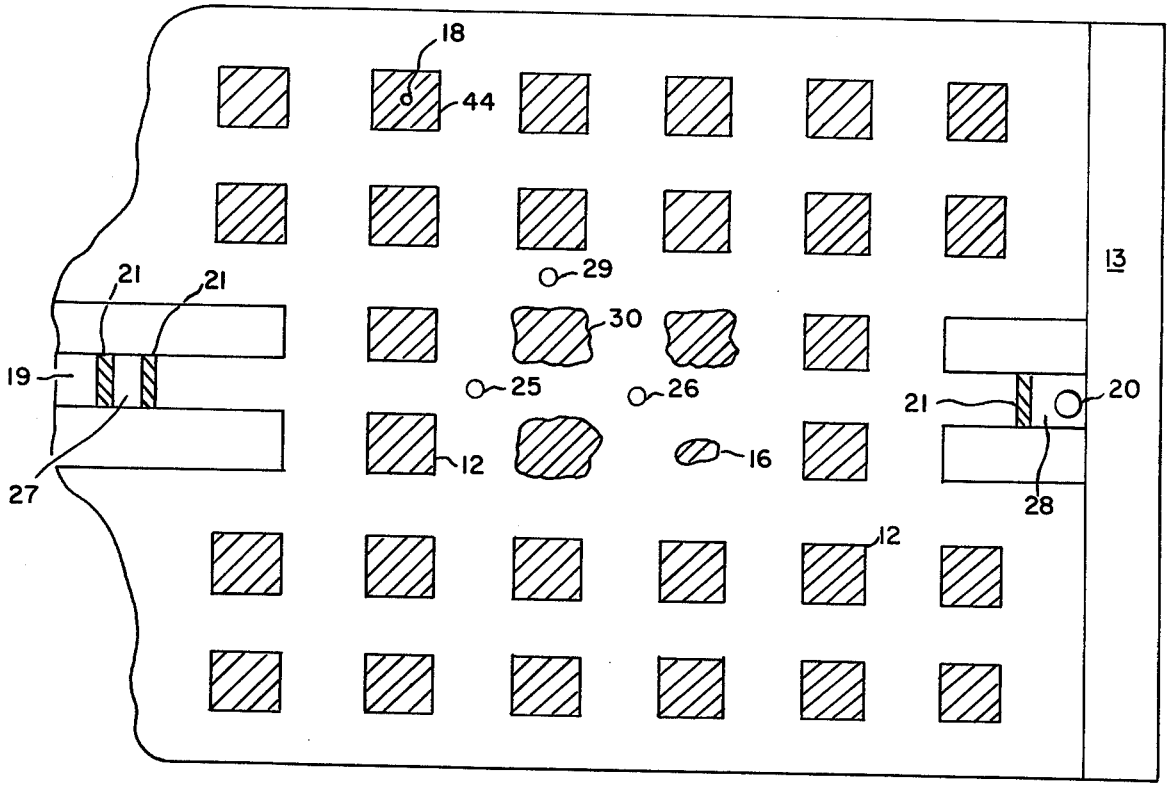
FIG. 2 is a diagrammatic plan view of an underground remnant coal deposit that is considered ideal to the practice of the instant invention.

In commercial practice a multiplicity of injector-producer wells would be drilled into the underground workings. For purposes of illustration, the bottom hole locations of four such wells are shown on FIG. 2. Wells 25, 26 and 29 are drilled into the "rooms" around remnant pillar 30, and well 18 is drilled into remnant pillar 44. These wells, together with other injector-producer wells not shown, provide numerous alternatives for fluid flow directions underground both for oxidizer injection and for withdrawal of products of combustion. Some of these alternatives are described herein, and those skilled in the art will be able to envision numerous other alternatives within the scope of the disclosure.

Looking first to well 18, this well is drilled and hermetically sealed as described in the foregoing description of well 26. The well bore is then deepened into the coal within remnant pillar 44. In one alternate explosives, for example an ammonium nitrate fuel oil mixture, may be positioned in the lower part of the well bore within remnant pillar 44 and the charge detonated to create communication passages between well 18 and the void space of the underground workings. In another alternate, the well bore within remnant pillar 44 may be ignited, for example by dropping hot charcoal briquettes into the well bore, and the coal in remnant pillar 44 set afire by continuous injection of oxidized through well 18, with an injection pressure of for example 200 psig. The second alternate is preferable when well 18 is selected as the site for the initial production of the underground coal deposit. If well 18 is used to initiate the in situ production of the coal, the underground workings will be at relatively low gas pressure, for example 14.7 psia, and the fire in remnant pillar 44 will proceed as a forward burn from well bore 18. Due to differential pressure the products of combustion will migrate through the natural permeability in the coal and into the void space of the underground workings. This method may be continued if desired until the mine pressure reaches the planned level, for example 50 psig, before it is necessary to engage a production well.

Preferably, however, the coal deposit is ignited in several locations early in the production sequence. For example, shortly after well 18 is ignited well 26 can be ignited, for example by dropping hot charcoal briquettes onto the coal in the mine floor underneath well 26. Oxidizer injection continues, for example at a pressure of 100 psig, in well 26 and when the mine pressure reaches the desired level, for example 50 psig, well 29 is engaged as a production well for withdrawing the products of combustion to surface facilities. Sufficient backpressure is maintained in well 29 to maintain the desired level of mine pressure, for example 50 psig. In this mode the two fire locations are propagating as forward burns toward well 29. Similarly the coal near well 25 may be ignited for the third fire location with propagation in a forward mode toward well 29.

Generally after the various underground fires are well established, the temperature of the underground gases is significantly higher than the temperature of the injected oxidizer, for example compressed air. Thus the oxidizer will tend to sink and spread until the oxygen content is consumed. The differential temperatures and pressures underground create considerable turbulence which is generally beneficial to the in situ production processes, particularly in converting virgin coal into low BTU fuel gas. In some cases an oxidizer bypass situation may occur such as the air injected into well 25 proceeding along the roof of the mine workings and on to well 29. In this case the low BTU gas generated between wells 26 and 18 enroute to production well 29 may be further burned by the excess oxidizer supply from well 25, and thus the gasses will arrive at the surface with no calorific content except for sensible heat. Corrective action may be taken by installing an oxidizer injection line (not shown) within well 25 so that the oxidizer release point is near the floor of the mine workings. An alternate corrective action would be to reduce the oxidizer injection pressure into well 25 to for example 65 psig.

In time, with the initiation of numerous fire points in the underground workings, the mine temperature will increase to the point where all exposed coal is at a temperature above its ignition point. When this occurs the in situ production techniques reach maximum flexibility, because the fire areas may be propagated by selective control of oxidizer distribution. In areas of the underground workings where there is an insufficiency of oxygen for combustion, the coal is at a temperature well within the range of pyrolysis temperatures and medium BTU fuel gases are being expelled for collection by a nearby production well. Steam may be injected into the hottest areas resulting in a reaction with coal to generate carbon dioxide and hydrogen for collection by a nearby production well, and the like. Also the residual coal can be consumed in patterns that induce subsidence in a reasonably uniform manner.

Thus it may be seen that an underground coal deposit of no apparent economic value can be converted to commercial products and that the perils of subsidence can be foreshortened and controlled.

While the instant invention has been described with a certain degree of particularity it is recognized that changes in details of structure may be made without departing from the spirit thereof.

What is claimed is:

1. A method of sealing an underground coal deposit wherein communication channels have been established between the underground coal and the surface of the ground, comprising the steps of establishing a first barricade means in a first communication channel wherein the said first communication channel has been created by the removal of a portion of the said underground coal, establishing a second barricade means in the said first communication channel, the second barricade means being adjacent to but spaced apart from the said first barricade means, establishing a first communication passage between the surface of the earth and the void space between the said first barricade and the said second barricade, injecting a fluid into the said first communication passage, establishing a fluid head pressure within the said void space, and establishing a fluid head pressure within the said first communication passage, establishing a second communication passage between the surface of the earth and a subsidence crack within the earth, said subsidence crack being in fluid communication with the underground coal deposit, injecting a fluid into the said second communication passage, the said fluid having the capability of sealing the said subsidence crack, and establishing a fluid head pressure within the said subsidence crack.

2. The method of claim 1 wherein the said fluid is a slurry composed of a carrier liquid with suspended solid substances.

3. The method of claim 2 wherein the said slurry is composed of water as the said carrier liquid and native clay as the said suspended solid substances.

4. The method of claim 1 further including the step of establishing a fluid head pressure within the said second communication passage.

5. A method of sealing an underground coal deposit wherein a subsidence crack forms a communication passage between the surface of the earth and the said underground coal, comprising the steps of injecting a fluid into the said subsidence crack, the said fluid having the capability of sealing the said subsidence crack, sealing the said subsidence crack, and continuing injecting the said fluid into the said subsidence crack until sufficient fluid head pressure is established to withstand planned mine pressure within the said underground coal.

6. The method of claim 5, wherein additional subsidence of the earth breaks the said seal in the said subsidence crack, further including the step of injecting the said fluid until the seal in the said subsidence crack is restored.

* * * * *